US005898999A

United States Patent [19]

Chaouachi et al.

[11] Patent Number: 5,898,999

[45] Date of Patent: May 4, 1999

[54] HAIR CUTTING APPARATUS WITH COMB DEVICE

[75] Inventors: Jaleleddine Chaouachi; Jürgen Holzbauer, both of Klagenfurt; Stephan Leitner, Kappel; Siegfried Seufzer, Viktring, all of Austria

[73] Assignee: U.S. Philips Corporation, New York, N.Y.

[21] Appl. No.: 08/984,824

[22] Filed: Dec. 4, 1997

[30] Foreign Application Priority Data

Dec. 13, 1996 [EP] European Pat. Off. ..... 968901900

[51] Int. Cl.[6] ..... B26B 19/20

[52] U.S. Cl. ..... 30/201; 30/200

[58] Field of Search ..... 30/43.1, 195, 196, 30/200, 201, 202, 233, 233.5

[56] References Cited

U.S. PATENT DOCUMENTS

| | | | |
|---|---|---|---|
| D. 375,035 | 10/1996 | Mangol | D8/DIG. 7 |
| 726,795 | 4/1903 | Cornu | 310/50 |
| 1,507,716 | 9/1924 | Redman | 310/47 |
| 1,899,102 | 2/1933 | Michael | 30/202 |
| 1,928,000 | 9/1933 | Adelmo | 30/202 |
| 1,982,979 | 12/1934 | Buller | 30/202 |
| 2,013,279 | 9/1935 | Maleev | 30/202 |
| 2,294,713 | 9/1942 | Boerger | 310/50 |
| 2,480,920 | 9/1949 | Gullong | 30/202 |
| 2,650,993 | 9/1953 | Brown et al. | 310/50 |
| 3,287,805 | 11/1966 | De Charme | 30/202 |
| 3,334,416 | 8/1967 | Green | 30/200 |
| 3,805,136 | 4/1974 | Meyer et al. | 310/50 |
| 4,085,503 | 4/1978 | Beck et al. | 30/201 |
| 4,557,050 | 12/1985 | Haraguchi et al. | 30/201 |
| 4,581,822 | 4/1986 | Fujimura | 30/201 |
| 4,669,189 | 6/1987 | Ullmann | 30/196 |
| 5,050,305 | 9/1991 | Baker et al. | 30/201 |
| 5,325,589 | 7/1994 | Kubo | 30/201 |

FOREIGN PATENT DOCUMENTS

| | | | |
|---|---|---|---|
| 648078 | 7/1937 | Germany | 30/196 |
| 61-79483 | 4/1986 | Japan . | |

OTHER PUBLICATIONS

European Search Report PCT/IB97/01332 dated Feb. 1998.
European Search Report PCT/IB97/01366 dated Feb. 1998.
Philips "Designation HS 025" (2 pages).

*Primary Examiner*—Hwei-Siu Payer
*Attorney, Agent, or Firm*—Ernestine C. Bartlett

[57] ABSTRACT

A hair-cutting system (1) is provided comprising a hair-cutting apparatus (2) having a toothed cutting device (17), and comprising a comb device (20) which can be mounted onto the hair-cutting apparatus (2) and comprises a stationary comb section (22) and an adjustable comb section (23), and comprising positioning means by which the adjustable comb section (23) can be positioned with respect to the stationary comb section (22), the stationary comb section (22) and the adjustable comb section (23) are loaded relative to one another by means of at least one spring (48), and the positioning means comprise an adjustment device (50) arranged on the hair-cutting apparatus (2), which adjustment device is adjustable to a number of settings by the hand in which the hair-cutting apparatus (2) is held during operation, and coupling means (51) are arranged between the adjustment device (50) and the adjustable comb section (23) for automatically coupling the adjustment device (50) and the adjustable comb section (23) when the comb device (20) is mounted onto the hair-cutting apparatus (2), and the adjustable comb section (23) is automatically movable into a desired operating position when the comb device (20) is mounted onto the hair-cutting apparatus (2).

13 Claims, 6 Drawing Sheets

HAIR CUTTING APPARATUS WITH COMB DEVICE

BACKGROUND OF THE INVENTION

Hair-cutting system including a hair-cutting apparatus and including a comb device which can be mounted onto the apparatus and which has two spring-loaded comb sections The invention relates to a hair-cutting system comprising a hair-cutting apparatus for cutting hairs, which apparatus is held in one hand during operation and comprises a toothed cutting device, and comprising a comb device which can be mounted onto the hair-cutting apparatus at the location of the toothed cutting device thereof in a mounting direction and which can be removed from the hair-cutting apparatus in a direction opposite to the mounting direction, which comb device comprises a comb section which is stationarily mounted with respect to the hair-cutting apparatus when the comb device has been mounted on the hair-cutting apparatus, and a comb section which is adjustable with respect to the stationarily mounted comb section, and comprising positioning means by which the adjustable comb section can be positioned in at least two operating positions with respect to the stationarily mounted comb section.

Such a hair-cutting system of the type defined in the opening paragraph is known, for example from the document JP 61-79.483 A1. In this known hair-cutting system the positioning means have been arranged exclusively on the comb device and are formed by a latching device which acts between the stationarily mounted comb section and the adjustable comb section. Owing to this construction the adjustable comb section of the comb device in the known hair-cutting system can only be adjusted with one hand while the hair-cutting apparatus is being held in the other hand, as a result of which the hair-cutting apparatus is comparatively difficult to handle. Moreover, as a result of the construction used in the known hair-cutting system it is not unlikely that when the comb device is placed onto the hair-cutting apparatus of this system the adjustable comb section is moved out of the desired preselected operating position defined by the latching device, so that a preselected desired hair-cutting length is altered in an undesirable manner.

SUMMARY OF THE INVENTION

It is an object of the invention to preclude the afore-mentioned problems and to provide an improved hair-cutting system in which the afore-mentioned problems are eliminated in a simple manner and by simple means. According to the invention, in order to achieve this object in a hair-cutting system of the type defined in the opening paragraph, the stationarily mounted comb section and the adjustable comb section are loaded relative to one another by means of at least one spring, and the positioning means comprise an adjustment device arranged on the hair-cutting apparatus, which adjustment device is adjustable to at least two selectable settings by the hand in which the hair-cutting apparatus is held during operation, and coupling means are arranged between the adjustment device and the adjustable comb section for automatically coupling the adjustment device and the adjustable comb section when the comb device is mounted onto the hair-cutting apparatus, and the adjustable comb section, when the comb device is mounted onto the hair-cutting apparatus, is automatically movable into a desired operating position with the aid of the adjustment device via the coupling means, which operating position is determined by the selected setting of the adjustment device. In this way it is achieved that while the hair-cutting apparatus is held in one hand the adjustment device can be adjusted with the same hand in order to obtain a desired operating position of the adjustable comb section of the comb device, as a result of which a hair-cutting system in accordance with the invention is simple and easy to handle. Moreover, the hair-cutting system in accordance with the invention ensures that when the comb device is placed onto the hair-cutting apparatus the adjustable comb section of the comb device is set to the desired operating position preset or preselected by a user with the aid of the adjustment device.

In a hair-cutting system in accordance with the invention it has proved to be advantageous if the adjustment device comprises a button, which can be set to at least two selectable settings by the hand in which the hair-cutting apparatus is held during operation, and a component part, which is movable by means of the button, and transmission means, which are connected to the component part and via which the component part is operatively connected to the coupling means. This is advantageous for a simple and proper adaptation of the construction to the given geometry of the hair-cutting apparatus. Moreover, it enables the construction to be simplified.

In a hair-cutting system as defined in the preceding paragraph it has further proved to be advantageous if the component part, which is movable by means of the button, and the transmission means are connected to one another via a hinge connection. As a result of this, it is simple to obtain different adjustment directions for the button-actuated component part and the transmission means.

In preferred embodiments, the button can be latched in each of its settings. This ensures that an inadvertent actuation of the button and, consequently, of the coupling means defining the preselected operating position of the adjustable comb section is avoided.

In all the afore-mentioned variants of a hair-cutting system in accordance with the invention, in which the comb device can be mounted onto the hair-cutting apparatus in a mounting direction, the adjustable comb section can be adjustable with respect to the stationarily mounted comb section in an adjustment direction which differs from the mounting direction. However, it has proved to be particularly advantageous if, when the comb device has been mounted on the hair-cutting apparatus, the adjustable comb section is adjustable with respect to the stationarily mounted comb section in a direction parallel to the mounting direction. This is advantageous for a particularly simple construction of a hair-cutting system in accordance with the invention.

In a hair-cutting system as defined in the preceding paragraph it has proved to be advantageous if the housing of the hair-cutting apparatus has two diametrically opposed guide grooves, which extend parallel to the mounting direction and which are open at the housing end in the area of the toothed cutting device, and the stationarily mounted comb section comprises two guide members, which each engage stationarily in a guide groove when the comb device has been mounted onto the hair-cutting apparatus, and the adjustable comb section comprises two further guide members, which each engage slidably in a guide groove when the comb device has been mounted onto the hair-cutting apparatus, and the coupling means between the adjustment device and the adjustable comb section are accommodated in at least one of the two guide grooves. This is advantageous in view of a compact construction and in view of a reliable and stable guiding of the comb device relative to the hair-cutting apparatus.

In a hair-cutting system as defined in the preceding paragraph it has proved to be particularly advantageous if the two guide members of the stationarily mounted comb section are cross-sectionally U-shaped, their bottom walls being remote from one another, and the two further guide members of the adjustable comb section are also cross-sectionally U-shaped, each of the U-shaped further guide members of the adjustable comb section engaging in a respective one of the U-shaped guide members of the stationarily mounted comb section. This is advantageous for a particularly compact construction because the guide members fit into one another.

In a hair-cutting system as defined in the preceding paragraph it has further proved to be very advantageous if a helical spring is arranged at least between one U-shaped guide member of the stationarily mounted comb section and a U-shaped further guide member of the adjustable comb section, which further guide member engages in the first-mentioned guide member, which spring extends in the same direction as the two guide members and acts upon the two guide members. Such a construction also has the advantage of a particularly compact construction because the helical spring requires hardly any additional space, the space inside the U-shaped guide members, which is available anyway, being utilized to accommodate this spring.

In a hair-cutting system in which the hair-cutting apparatus has two diametrically opposed guide grooves it has proved to be advantageous if the coupling means comprise coupling pins, which project from the interior of the housing of the hair-cutting apparatus into the guide grooves through passages in the housing, and coupling stops, which are arranged on the further guide members of the adjustable comb section. This is advantageous for a simple and reliable construction, where the coupling means are well protected.

Furthermore, it is preferred that the coupling pins extend through slot-shaped passages formed in the bottom walls of the guide grooves. This has proved to be advantageous for a simple practical implementation.

In all the above variants of a hair-cutting system in accordance with the invention the stationarily mounted comb section and the adjustable comb section can be spring-loaded relative to one another by at least one pressure spring, or a blade spring, or a rod spring. However, it is especially preferred to provide at least one tension spring for loading the stationarily mounted comb section and the adjustable comb section relative to one another. Such a construction has proved to be particularly reliable and effective in practice.

In all the above variants of a hair-cutting system in accordance with the invention it is especially preferred that the stationarily mounted comb section comprises a plurality of comb teeth, which extend down to the toothed cutting device and the adjustable comb section comprises an equal plurality of comb teeth, and when the adjustable comb section has been moved with respect to the stationarily mounted comb section opposed by the force of the spring the comb teeth of the stationarily mounted comb section forms extensions of the comb teeth of the adjustable comb section down to the toothed cutting device. This guarantees that hairs to be trimmed are fed properly to the toothed cutting device in all the telescoped operating conditions of the comb device.

It has further proved to be particularly advantageous if the comb teeth of the stationarily mounted comb section are strip-shaped and extend parallel to the mounting direction with their longitudinal strip directions, and the comb teeth of the adjustable comb section are wedge-shaped and each have a channel which extends parallel to the mounting direction, a strip-shaped comb tooth of the stationarily mounted comb section extending in each duct or channel. This is very advantageous for a simple and compact construction and, in addition, it provides a satisfactory guidance of the adjustable comb section with respect to the stationarily mounted comb section.

The afore-mentioned as well as further aspects of the invention will be apparent from the embodiments described hereinafter by way of examples and will be elucidated on the basis of these embodiments.

BRIEF DESCRIPTION OF THE DRAWINGS

The invention will now be described in more detail with reference to the drawings, which show two embodiments given by way of examples but to which the invention is not limited.

DETAILED DESCRIPTION OF THE PREFERRED EMBODIMENTS

Figure 1:
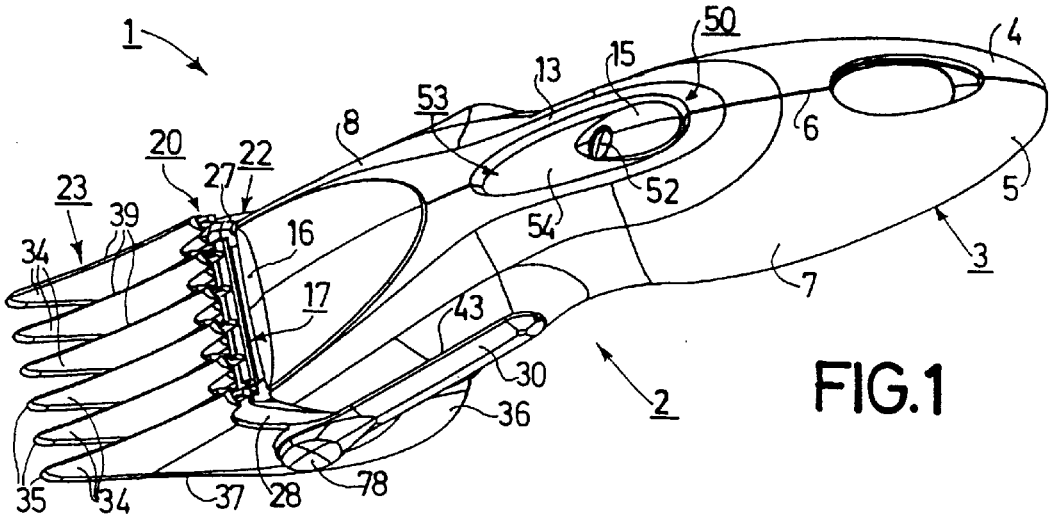
FIG. 1 is a slightly scaled-down oblique view from above, showing a hair-cutting system in accordance with a first embodiment of the invention, which system comprises a hair-cutting apparatus and a comb device mounted on the hair-cutting apparatus and comprising a comb section which is stationarily mounted relative to the hair-cutting apparatus and an adjustable comb section, the two comb sections being spring-loaded relative to one another by means of a tension spring.
Figure 2:
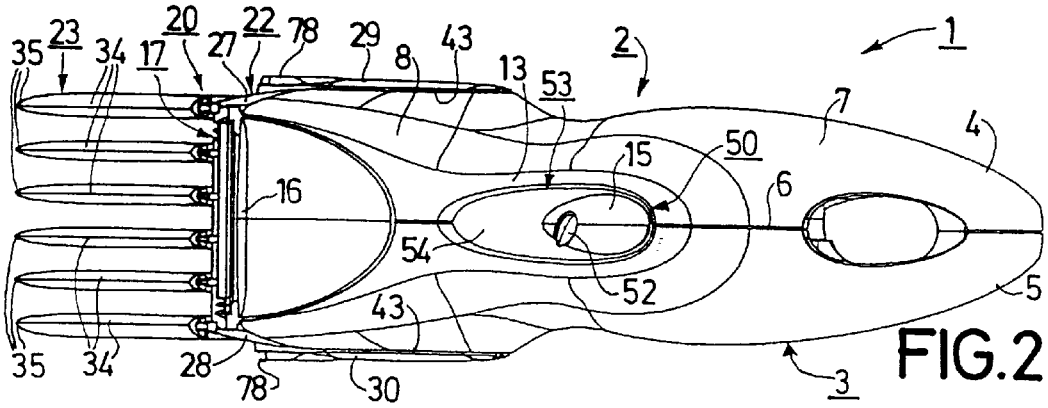
FIG. 2 is a plan view of the hair-cutting system shown in FIG. 1.
Figure 3:
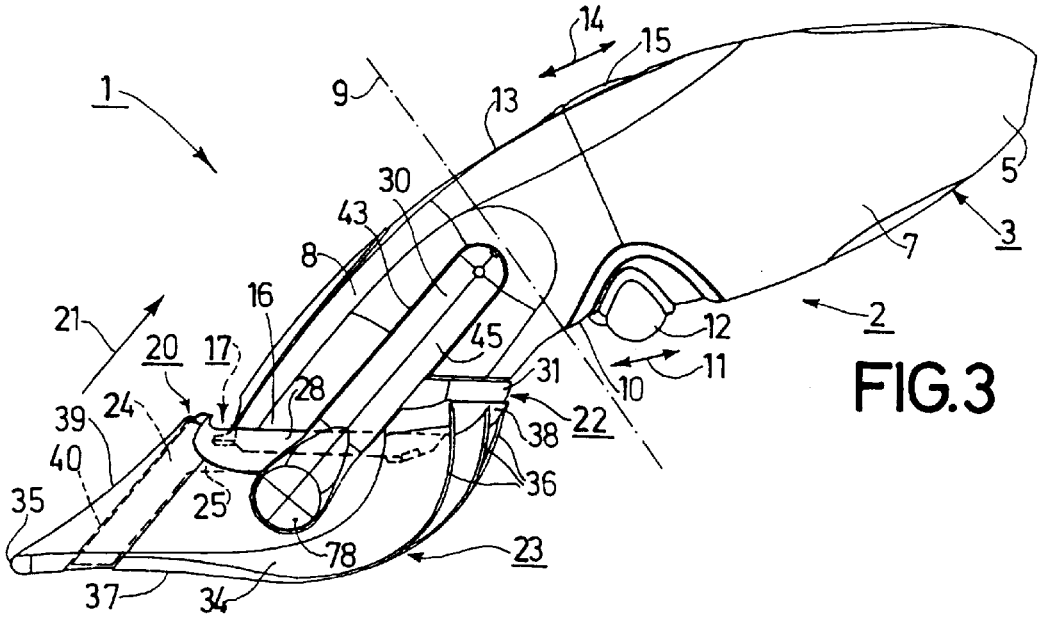
FIG. 3 is a side view of the hair-cutting system shown in FIGS. 1 and 2.

FIGS. 1 to 5 and 11 show a hair-cutting system 1. The hair-cutting system 1 comprises a hair-cutting apparatus 2 for cutting hairs, which apparatus is held in a hand during operation. The hair-cutting apparatus 2 has an elongate housing 3, which basically comprises two housing halves 4 and 5, which adjoin one another along a parting line 6. The housing 3 has an angular shape, as is apparent from FIGS. 3 to 5. The housing 3 comprises a first housing part 7 and a second housing part 8 which projects from the first housing part 7 and is inclined relative to the first housing part. The two housing parts 7 and 8 adjoin one another substantially in a transition zone indicated by a dash-dot line 9 in FIGS. 3 and 4.

An on/off sliding button 12 is arranged near the transition zone 9 in a convex portion 10 of the first housing part 7 and is movable between an off-position and an on-position as indicated by a double-headed arrow 11, enabling a drive motor, not shown, of the hair-cutting apparatus 2 to be turned on and turned off.

A button 15 is arranged near the transition zone 9 in a convex portion 13 of the first housing part 7 and is movable between a plurality of selectable settings as indicated by a double-headed arrow 14. The function of the button 15 will be described in detail hereinafter.

The hair-cutting apparatus 2 comprises a toothed cutting device 17 in the area of the distal end 16 of the second housing part 8, which toothed cutting device comprises a stationary toothed cutter 18 and a toothed cutter 19 which is reciprocatingly drivable by the motor, not shown, via drive means, not shown. The construction of such a toothed cutting device and the construction of a drive means for the reciprocatingly drivable toothed cutter of such a toothed cutting device are known and are not relevant in the present context, for which reason no further description is required.

By means of the toothed cutting device 17 it is possible, for example, to cut the hair on a person's head. When only the hair-cutting apparatus 2 is used, the problem arises that in the case of unskilled or improper use of the hair-cutting apparatus 2 the hairs may be shortened excessively, i.e. trimmed too short. In order to preclude this problem, the hair-cutting system 1 as shown in FIGS. 1 to 5 and 11 comprises a comb device 20, as can be seen in FIGS. 1 to 5 and 11. However, for the comb device 20 reference is also made to FIGS. 9 and 10, which show the comb device 20 to an enlarged scale.

Figure 4:
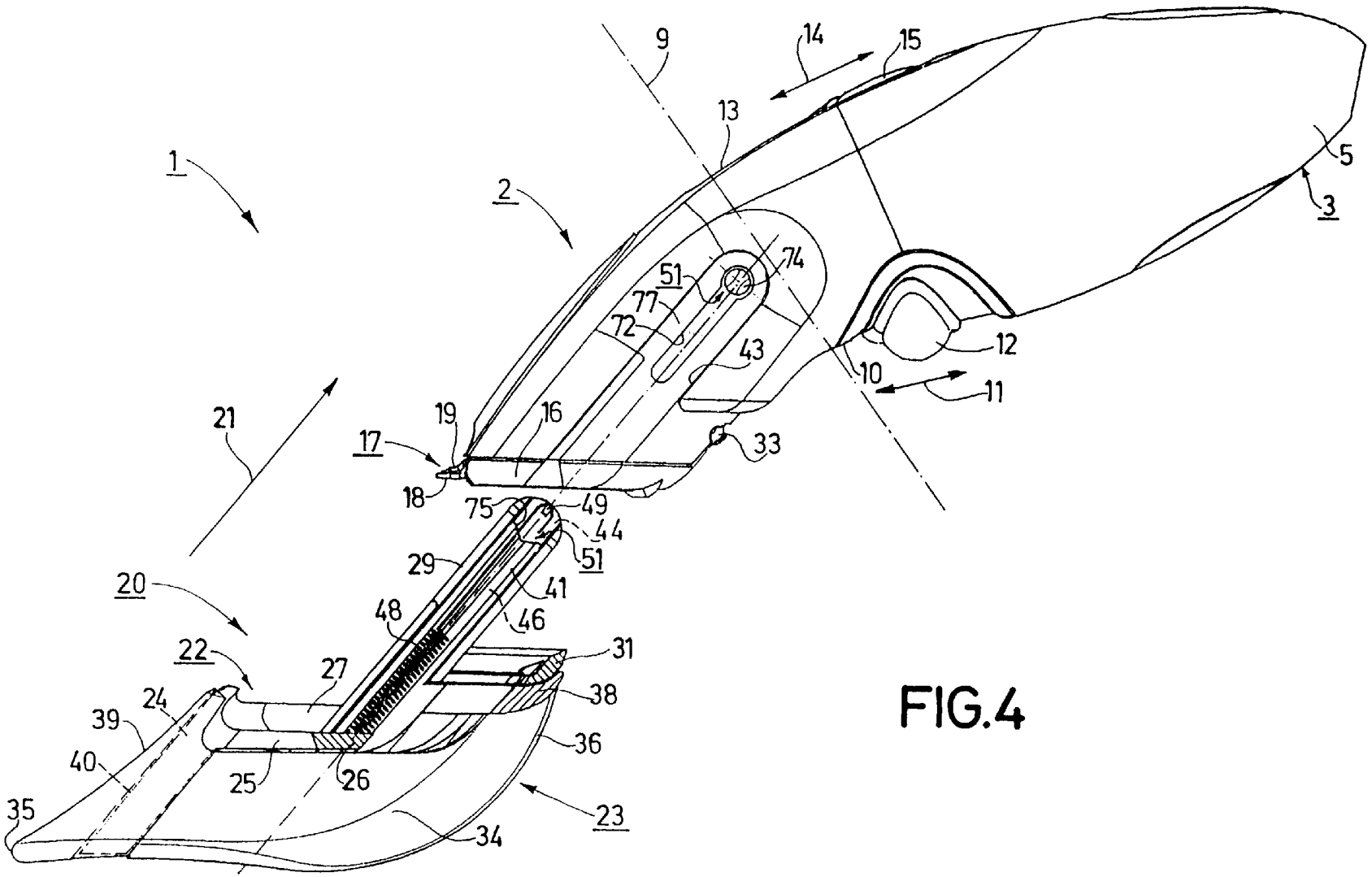
FIG. 4 is a side view of the hair-cutting system shown in FIGS. 1 to 3, the comb device being removed from the hair-cutting apparatus and the comb device being shown partly in sectional view.
Figure 5:
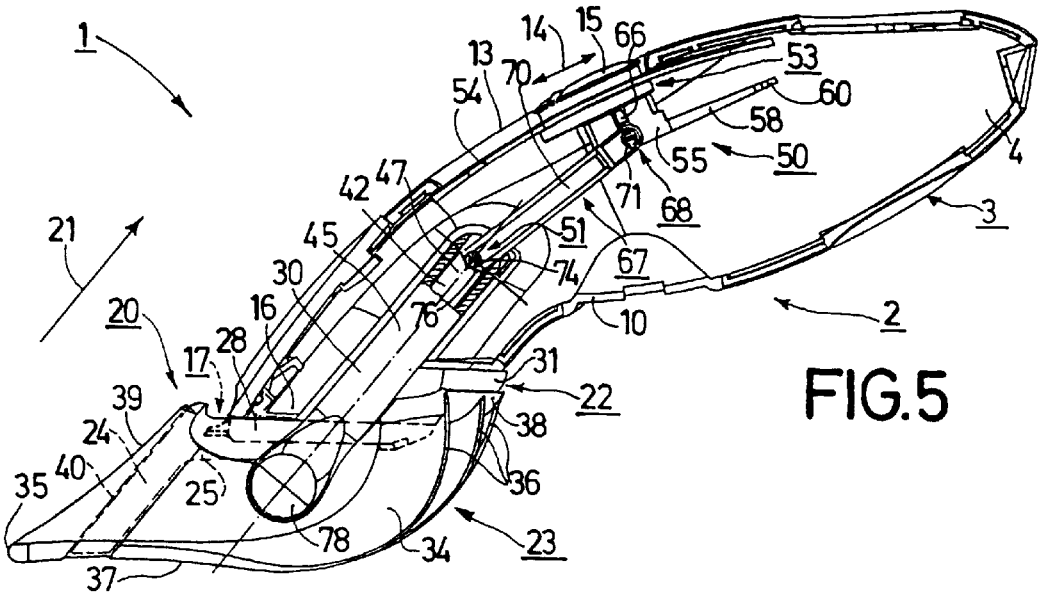
FIG. 5 shows the hair-cutting system of FIGS. 1 to 4 in a view similar to that in FIG. 3 but in which one housing half of the hair-cutting apparatus is not shown, so that an adjustment device is visible by means of which the adjustable comb section of the comb device can be set into a desired operating position.
Figure 6:
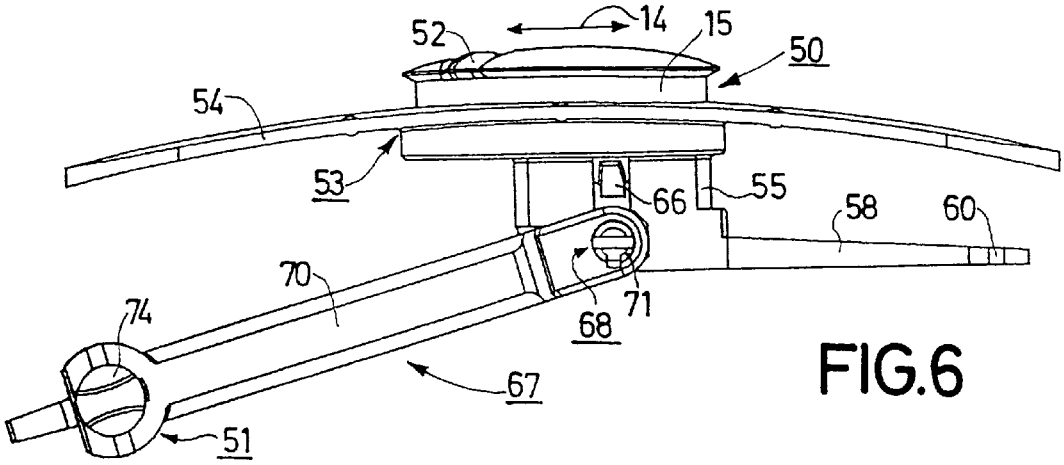
FIG. 6 a is a side view showing the adjustment device of the hair-cutting apparatus of the hair-cutting system of FIGS. 1 to 5 to an enlarged scale in comparison with FIG. 5.

The comb device 20, as is indicated by an arrow 21 in FIG. 4, can be mounted onto the hair-cutting apparatus 2 in the area of its toothed cutting device 17 in a mounting direction 21. Likewise, the comb device 20 is detachable from the hair-cutting apparatus 2 in a direction opposite to the mounting direction 21.

The comb device 20 is a telescoping comb device, also referred to as a telescopic comb. To enable telescoping, the comb device 20 comprises a comb section 22, which is mounted stationarily relative to the hair-cutting apparatus 2 when the comb device 20 is attached to the hair-cutting apparatus 2, and a comb section 23, which is adjustable relative to the stationarily mounted comb section 22 and, consequently, relative to the hair-cutting apparatus 2 and thus also relative to the toothed cutting device 17.

The stationarily mounted comb section 22 comprises six strip-shaped juxtaposed comb teeth 24, which each extend parallel to the mounting direction 21 down to the toothed cutting device 17. Each of the comb teeth 24 is integrally connected to a connecting member 26 via an arm 25. The two outer arms 25 are each integrally connected to a reinforcement rib 27 and 28. The stationary comb section 22 further comprises two guide members 29 and 30, of which the first guide member 29 is integrally connected to the reinforcement rib 27 and to the connecting member 26, and the second guide member 30 is integrally connected to the reinforcement rib 28 and to the connecting member 26. The two guide members 29 and 30 of the stationary comb section 22 are integrally connected to one another by an arcuate further connecting member 31. In its central part the further connecting member 31 has a latching projection 32 adapted to cooperate with a latching nose 33 provided on the hair-cutting apparatus 2. When the comb device 20 is mounted onto the hair-cutting apparatus 2 the latching projection snaps behind the latching nose 33, thus forming a latched connection which stationarily secures the comb section 22 of the comb device 20 to the hair-cutting apparatus 2.

The adjustable comb section 23 also comprises six juxtaposed comb teeth 34, which are planiform—as is apparent particularly from the side views of the comb device 20—and which extend from their tooth tips 35 to their tooth backs 36. Between the tooth tip 35 and the tooth back 36 each comb tooth 34 has a slightly concave contact zone 37. By means of the contact zones 37 the comb teeth 34 can be applied to a skin area of a person, for example a person's scalp.

The comb teeth 34 of the adjustable comb section 23 are interconnected by an arcuate connecting member 38 at the location of the ends of the tooth backs 36. The arcuate connecting member 38 of the adjustable comb section 23 extends parallel to the similarly arcuate further connecting member 31 of the stationarily mounted comb section 22, as is apparent particularly from FIGS. 9 to 11. Slightly concave front zones 39 of the comb teeth 34 extend from the tooth tips 35 of the comb teeth 34 towards the hair-cutting apparatus 2, i.e. towards the toothed cutting device 17 thereof. Adjacent the front zones 39 of the comb teeth 34 each comb tooth 34 has a channel 40 which extends parallel to the mounting direction 21. A strip-shaped comb tooth 24 of the stationarily mounted comb section 22, which tooth is oriented in the mounting direction 21, extends in each duct 40. With respect to the adjustable comb section 23 it is to be noted that it comprises two further guide members 41 and 42, of which the first further guide member 41 is visible in FIGS. 4, 9 and 10 and the second further guide member 42 is visible in FIG. 5.

In the hair-cutting system 1 as shown in FIGS. 1 to 5 and 11, when the comb device 20 has been mounted on the hair-cutting apparatus 2, the adjustable comb section 23 is adjustable with respect to the stationarily mounted comb section 22 in a direction parallel to the mounting direction 21. In order to achieve this adjustment of the adjustable comb section 23 with respect to the stationarily mounted comb section 22 parallel to the mounting direction 21, the housing 3 of the hair-cutting apparatus 2 has two diametrically opposed guide grooves 43, which extend parallel to the mounting direction 21 and which are open at the distal end 16 of the housing in the area of the toothed cutting device 17, only one guide groove 43 being visible in FIGS. 1, 3, 4, 5 and 11.

As already stated hereinbefore, the stationarily mounted comb section 22 comprises two guide members 29 and 30 and the adjustable comb section 23 comprises two further guide members 41 and 42. With the comb device 20 mounted on the hair-cutting apparatus 2 each of the two guide members 29 and 30 engages stationarily in a guide groove 43. With the comb device 20 mounted on the hair-cutting apparatus 2 each of the two further guide members 41 and 42 of the adjustable comb section 23 engages slidably in a guide groove 43.

Figure 9:
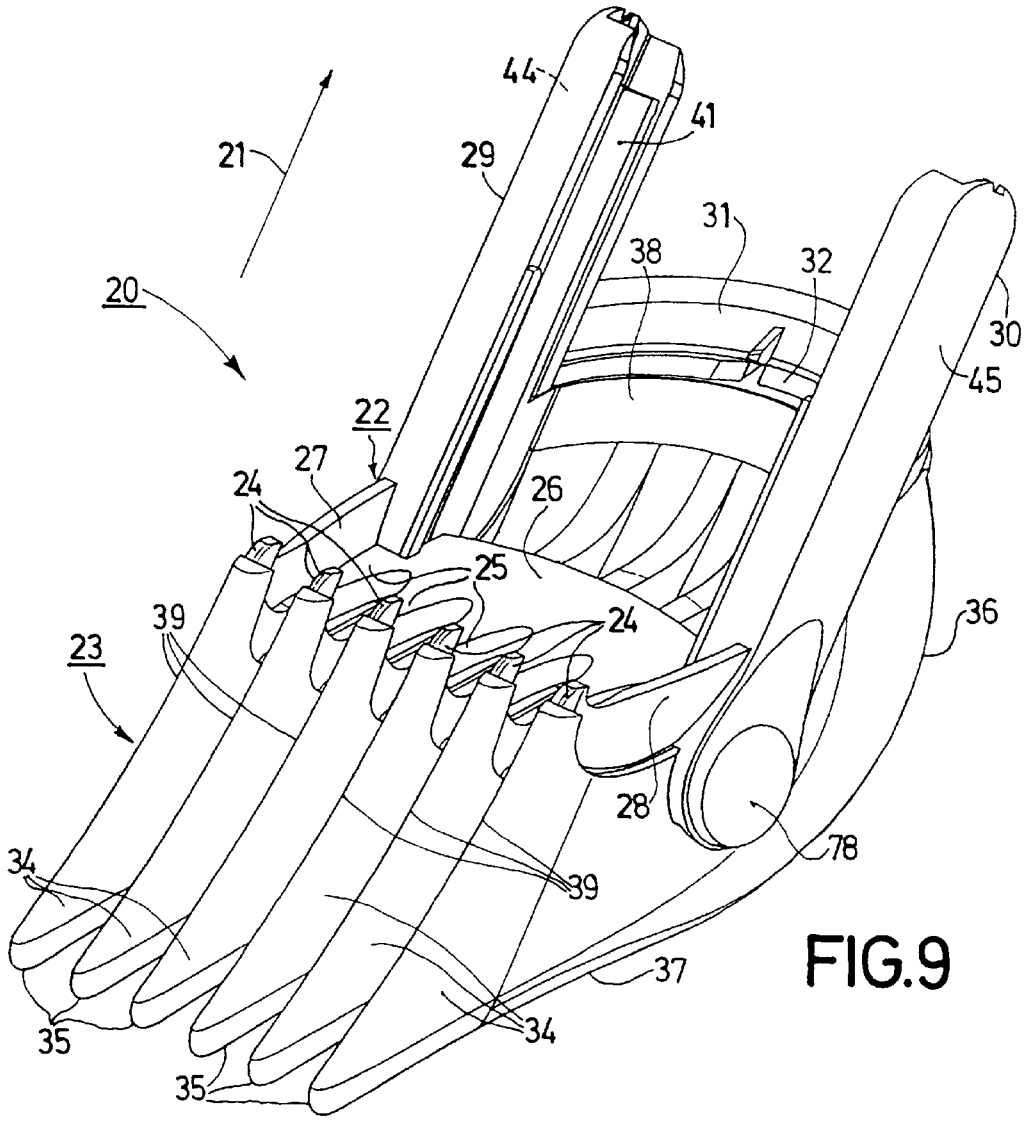
FIG. 9 shows the comb device of the hair-cutting system of FIGS. 1 to 5 in an oblique view from above, the adjustable comb section not being adjusted relative to the stationarily mounted comb section.

As is apparent in particular from FIG. 9, the two guide members 29 and 30 of the stationarily mounted comb section 22 are cross-sectionally U-shaped, their bottom walls (44, 45) being remote from one another. The two further guide members 41 and 42 of the adjustable comb section 23 are also cross-sectionally U-shaped, their bottom walls 46 and 47 being remote from one another. As is apparent from FIG. 9 for the first guide member 29 of the stationarily mounted comb section 22 and the first further guide member 41 of the adjustable comb section 23, each of the U-shaped further guide members 41 and 42 of the adjustable comb section 23 engages in a respective one of the U-shaped guide members 29 and 30 of the stationarily mounted comb section 22.

The hair-cutting system 1 as shown in FIGS. 1 to 5 and 11 comprises positioning means by which the adjustable comb section 23 can be positioned in a plurality of operating positions with respect to the stationarily mounted comb section 22. The construction of these positioning means will be described in more detail hereinafter.

Figure 10:
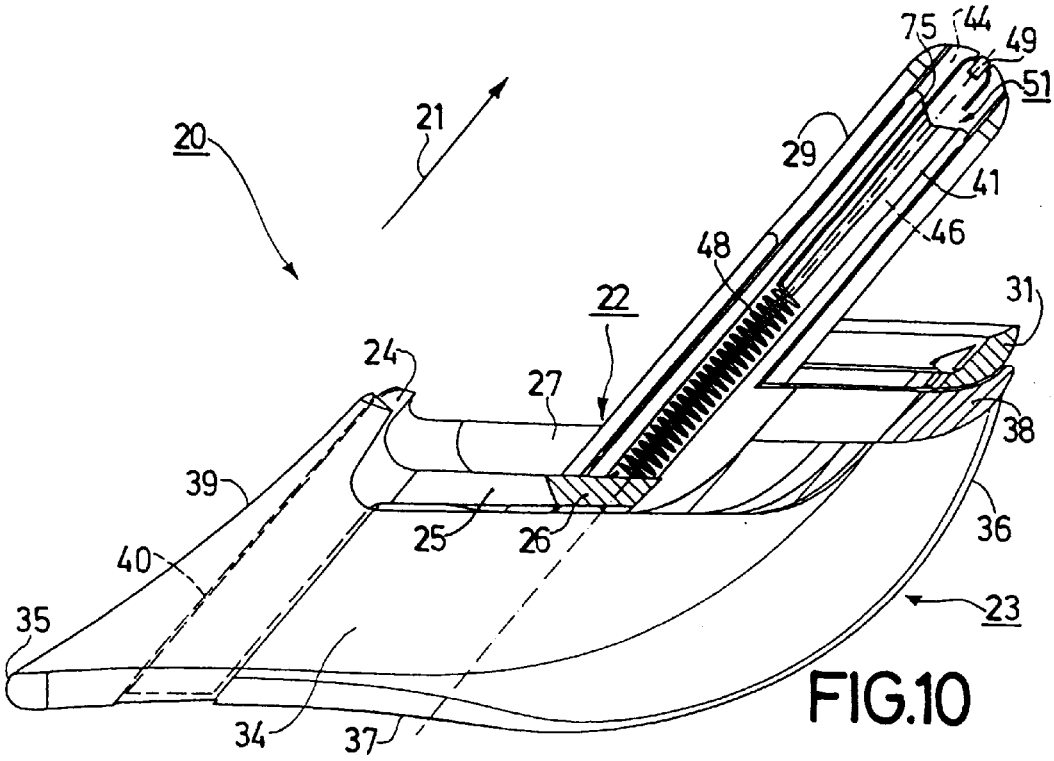
FIG. 10 shows the comb device of FIG. 9 in a side view, partly sectional view, in which the adjustable comb section has not been adjusted relative to the stationarily mounted comb section and which shows the tension spring by means of which the adjustable comb section is held in engagement with the stationarily mounted comb section.

However, first of all the essential fact is to be noted that in the hair-cutting system 1 as shown in FIGS. 1 to 5 and 11 the stationarily mounted comb section 22 and the adjustable comb section 23 are advantageously loaded relative to one another by means of a spring 48, as is apparent from FIGS. 4 and 10. As is further apparent from these two Figures, a helical spring 48 is arranged between the U-shaped first guide member 29 of the stationarily mounted comb section 22 and the U-shaped first further guide member 41 of the adjustable comb section 23, which cooperates with the first-mentioned guide member, which spring extends in the same direction as the two guide members 29 and 41 and acts upon the two guide members 29 and 41. The spring 48 for loading the stationarily mounted comb section 22 and the adjustable comb section 23 is suitably a tension spring. The spring 48 in the form of a tension spring has one end coupled to a projection 49 of the first guide member 29 of the stationarily mounted comb section 22. A second end of the spring 48 is coupled to a projection, not shown, of the first further guide member 41 of the adjustable comb section 23.

As stated hereinbefore, the hair-cutting system 1 comprises positioning means for adjusting and positioning the adjustable comb section 23 in a plurality of operating positions with respect to the stationarily mounted comb section 22. In the present case, these positioning means advantageously comprise an adjustment device 50, shown in FIGS. 5 to 8, which adjustment device has been provided on the hair-cutting apparatus 2 and can be set to a plurality of selectable settings with the hand in which the hair-cutting apparatus 2 is held during operation. Furthermore, coupling means 51 arranged between the adjustment device 50 and the adjustable comb section 23 serve for automatically coupling the adjustment device 50 and the adjustable comb section 23 when the comb device 20 is mounted onto the hair-cutting apparatus 2. When the comb device 20 is mounted onto the hair-cutting apparatus 2 the adjustable comb section 23 is automatically movable into a desired operating position with the aid of the adjustment device 50 via the coupling means 51, which operating position is determined by the selected setting of the adjustment device 50.

The adjustment device 50 includes the button 15 which can be set to a plurality of selectable settings with the hand in which the hair-cutting apparatus 2 is held during operation. The button 15 has been provided with a pointer 52 which cooperates with a scale graduation, not shown, on the housing 3 of the hair-cutting apparatus 2 to indicate the selected setting. The adjustment device 50 further comprises a component part 53 which is movable by means of the button 15 of the adjustment device 50. The movable part 53 comprises a curved plate portion 54, which is slidably guided by means of similarly curved guide grooves in the housing 3 of the hair-cutting apparatus 2. An essentially hollow cylindrical cross-sectionally rectangular sleeve portion 55 is integrally connected to the plate portion 54. At its end which is remote from the plate portion 54 the sleeve portion 55 is integrally connected to a bar portion 56. Two resilient arms 57 and 58 project laterally from the sleeve portion 55 at the side which is remote from the plate portion 54 and each have a latching projection, 59 and 60 respectively, at their free ends, which latching portions cooperate with latching teeth, not shown, provided in the housing 3 of the hair-cutting apparatus 2. By means of the two latching projections 59 and 60 and the latching teeth, not shown, the transition from one setting of the adjustment device 50 to an adjacent setting can be signalled in that a mechanical resistance is felt.

Figure 7:
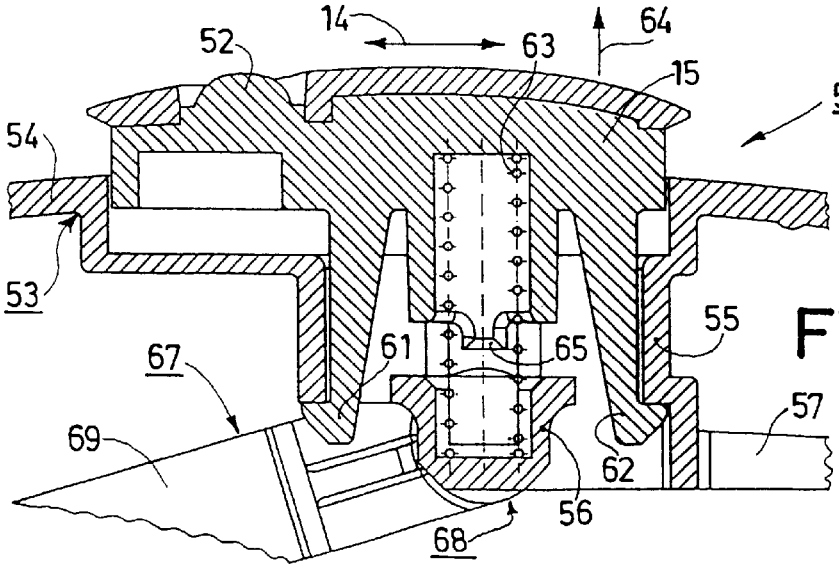
FIG. 7 is a sectional view of a detail of the adjustment device shown in FIG. 6.
Figure 8:
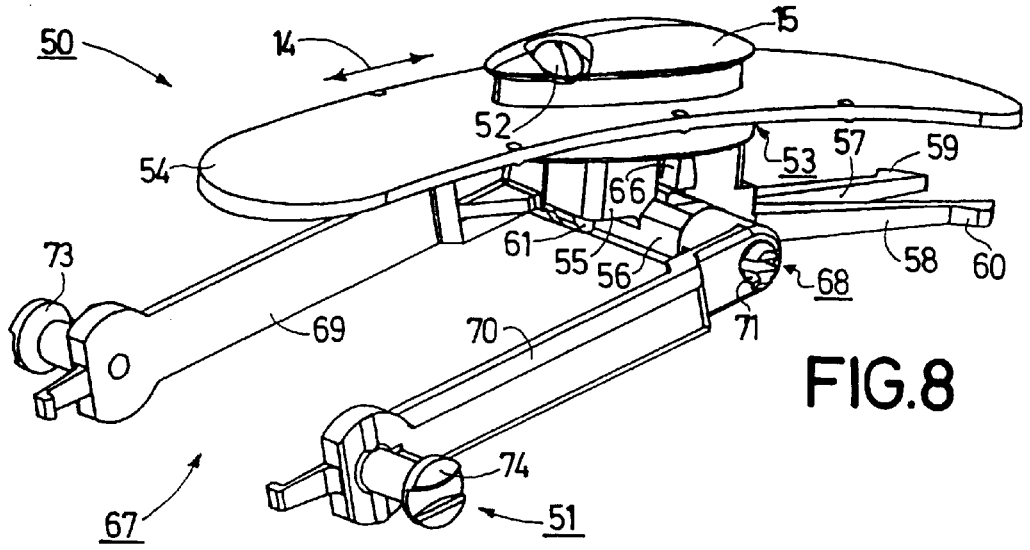
FIG. 8 shows the adjustment device of FIG. 6 in an oblique view from above.

As is apparent particularly from FIG. 7, the button 15 is coupled to the component part 53 in that two latching arms 61 and 62, which project from the button 15, engage behind the sleeve portion 55 of the part 53. As is further apparent from FIG. 7, a pressure spring 63 is arranged between the button 15 and the bar portion 56 of the component part 53, which urges the button 15 in the direction indicated by an arrow 64 shown in FIG. 7. Two latching projections 65 and 66 project laterally from the button 15, the latching projection 65 being shown in FIG. 7 and the latching projection 66 in FIG. 8. The two latching projections 65 and 66 traverse openings in the sleeve portion 55 of the component part 53. The two latching projections 65 and 66 are each adapted to cooperate with latching teeth, not shown, provided in the housing 3 of the hair-cutting apparatus 2.

When the button 15 assumes its rest position shown in FIGS. 1 to 8 under the influence of the force exerted by the pressure spring 63, the two latching projections 65 and 66 engage with the latching teeth, not shown, as a result of which the button 15 and, consequently, the adjustment device 50 cannot be moved in a parallel to the direction indicated by the double-headed arrow 14. The button 15 and, as a consequence, the adjustment device 50 are thus latched in a first setting. Likewise, the button 15 and, consequently, the adjustment device 50 can be latched in each of their further settings. When the button 15 is pressed in a direction opposite to that indicated by the arrow 64 against the force of the pressure spring 63, the latching projections 65 and 66 are disengaged from the latching teeth, not shown, as a result of which the button 15 and, consequently, the adjustment device 50 can be moved, i.e. slid, to a desired setting in a direction parallel to that indicated by the double-headed arrow 14. When the button 15 is subsequently released the button 15 resumes its rest position under the influence of the pressure spring 63, upon which the latching projections 65 and 66 again engage with the latching teeth, not shown, thereby latching the button 15 and the adjustment device 50 in the desired setting.

The adjustment device 50 further comprises transmission means 67, which are connected to the component part 53 and which are operatively connected to the coupling means 51 via the component part 53. In the present hair-cutting system 1 the component part 53, which is movable by means of the button 15, and the transmission means 67 are connected to one another via a hinge connection 68. In the present case the transmission means 67 comprise two arms 69 and 70, which are each hingeably connected to the bar portion 56 of the component part 53 via a hinge 71, only one hinge 71 being shown in the Figures. Thus, said hinged connection 68 is formed by means of the two hinges 71.

For a better understanding it is to be noted that, as regards the coupling means 51, these means 51 comprise coupling pins 73 and 74, which project into the guide grooves 43 through passages 72 in the housing 3, and coupling stops 75 and 76, which are arranged on the two further guide members 41 and 42 of the adjustable comb section 23. Of the two coupling stops 75 and 76 the coupling stop 75 is visible in FIGS. 4 and 10 and the coupling stop 76 in FIG. 5. As regards the two passages 72 in the housing 3 it is to be noted that only one passage 72 is visible in FIG. 4. Said passages 72 are formed by slots in the bottom walls 77 of the guide grooves 43, through which slots the coupling pins 73 and 74 extend.

In the hair-cutting system 1 as shown in FIGS. 1 to 5 and 11 the hair-cutting apparatus 2 can be used for cutting hairs without the comb device 20, if this is desired by a user of the hair-cutting system 1. However, alternatively the hair-cutting system 1 can be used with the comb device 20 attached to the hair-cutting apparatus 2, hairs being cut in such a manner that by means of the comb device 20 always a desired distance is maintained between the toothed cutting device 17 of the hair-cutting apparatus 2 and the skin surface from which the hairs to be cut project.

To mount the comb device 20 onto the hair-cutting apparatus 2 the comb device 20 is held, for example, between the forefinger and the thumb of one hand at the location of two grip zones 78 connected to the guide members 29 and 30 and subsequently—as indicated in FIG. 4—mounted onto the hair-cutting apparatus 2 in the mounting direction 21, the guide members 29 and 30 of the comb device 22, which after mounting is stationarily attached to the hair-cutting apparatus 2 by means of the latching nose 33 and the latching projection 32, being inserted into the guide grooves 43. During this insertion the coupling pins 73 and 74 can assume the operating position shown in FIG. 4, which is the case when the button 15 and, consequently, the adjustment device 50 are latched in the afore-mentioned first setting, which corresponds to the shortest hair-cutting length adjustable by means of the comb device 20. When the comb device 20 is mounted onto the hair-cutting apparatus 2 in the operating condition as illustrated in FIG. 4, the coupling stops 75 and 76 on the two further guide members 41 and 42 of the adjustable comb section 23 do not cooperate with the coupling pins 73 and 74 until the end of the mounting operation, as result of which the adjustable comb section 23 remains substantially in an unchanged position, so that the operating condition illustrated in FIGS. 1, 2, 3, 5, 9 and 10 is obtained when the comb device 20 has been mounted completely onto the hair-cutting apparatus 2.

However, if before the comb device 20 is mounted onto the hair-cutting apparatus 2 the adjustment device 50 has been set to another desired setting by means of the button 15—in which the button 15 and the adjustment device 50 are latched by means of the latching projections 65 and 66, the coupling pins 73 and 74 then assuming an operating position which is shifted in a direction opposite to that indicated by the arrow 21 with respect to the operating shown in FIG. 4—the coupling stops 75 and 76 already abut against the coupling pins 73 and 74 of the coupling means 51 at an earlier instant than in the previously described operating condition when the comb device 20 is mounted onto the hair-cutting apparatus 2, as a result of which the adjustable comb section 23 can no longer be moved any closer towards the hair-cutting apparatus 2, but only the comb section 22, which after it has been wholly slid onto the hair-cutting apparatus 2 is latched to the hair-cutting apparatus 2 by means of the latching projection 32 and the latching nose 33. In this way it is achieved that, when the comb device 20 is mounted onto the hair-cutting apparatus 2, the adjustable comb section 23 is automatically movable into a desired operating position, which is determined by the selected setting of the adjustment device 50, by means of the adjustment device 50 via the coupling means 51, i.e. the coupling pins 73 and 74 and the coupling stops 75 and 76.

Figure 11:
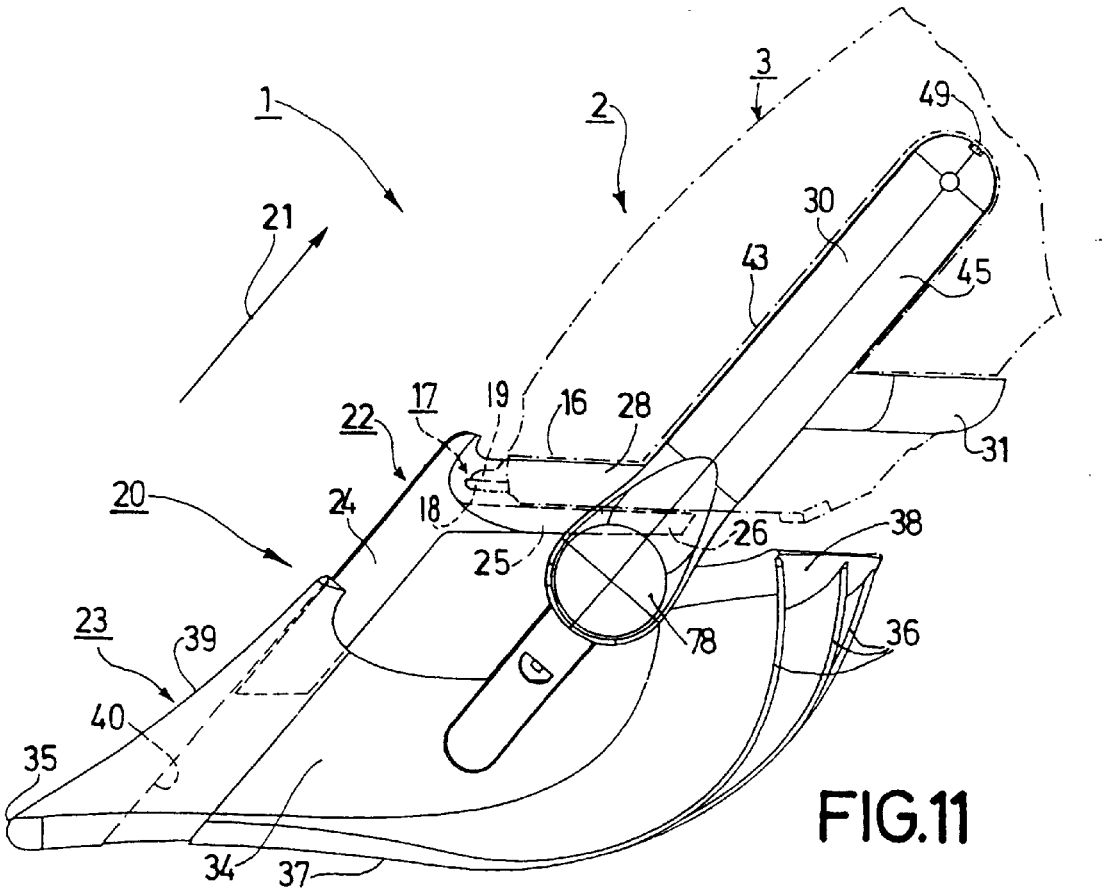
FIG. 11 shows a part of the hair-cutting system of FIGS. 1 to 5, the adjustable comb section of the comb device being held in a desired operating position with respect to the stationarily mounted comb section in opposition to the force of the tension spring.

In this way the adjustable comb section 23 is held in an operating position which is further away from the hair-cutting apparatus 2, so that in this case a greater hair cutting length is set, as is apparent from FIG. 11. Although in this case the adjustable comb section 23 is held in an operating position which is further away from the hair-cutting apparatus 2, it is achieved by means of the strip-shaped comb teeth 24 of the comb section 22, which is stationarily mounted on the hair-cutting apparatus 2, that by means of the strip-shaped comb teeth 24 of the stationarily mounted comb section 22 the comb teeth 34 of the adjustable comb section 23 are extended up to the toothed cutting device 17 of the hair-cutting apparatus 2, so that the hairs guided by the comb teeth 34 and the comb teeth 24 and to be severed by the toothed cutting device 17 are actually guided properly up to the toothed cutting device 17, which is advantageous for a correct guidance of the hairs to be cut and for a reliable cutting by means of the toothed cutting device 17.

The hair-cutting system 1 described above has advantage that with the aid of simple means it is achieved that while the hair-cutting apparatus 2 is held in one hand the button 15 and hence the adjustment device 50 can be adjusted with the same hand in which the hair-cutting apparatus 2 is held during operation, in order to obtain a desired operating position of the adjustable comb section 23 of the comb device 20. Thus, the hair-cutting system 1 described in the foregoing is simple and easy to handle. However, it is to be noted that the actuation of the button 15 and, consequently, of the adjustment device 50 need not necessarily be effected with the same hand in which the hair-cutting apparatus 2 is held during operation but can also be effected with the other hand if the user prefers this. By means of the hair-cutting system 1 it is further ensured that when the comb device 20 is mounted onto the hair-cutting apparatus 2 the adjustable comb section 23 of the comb device 20 is always set to the operating position desired by a user and preselected by a user by means of the adjustment device 50.

Figure 12:
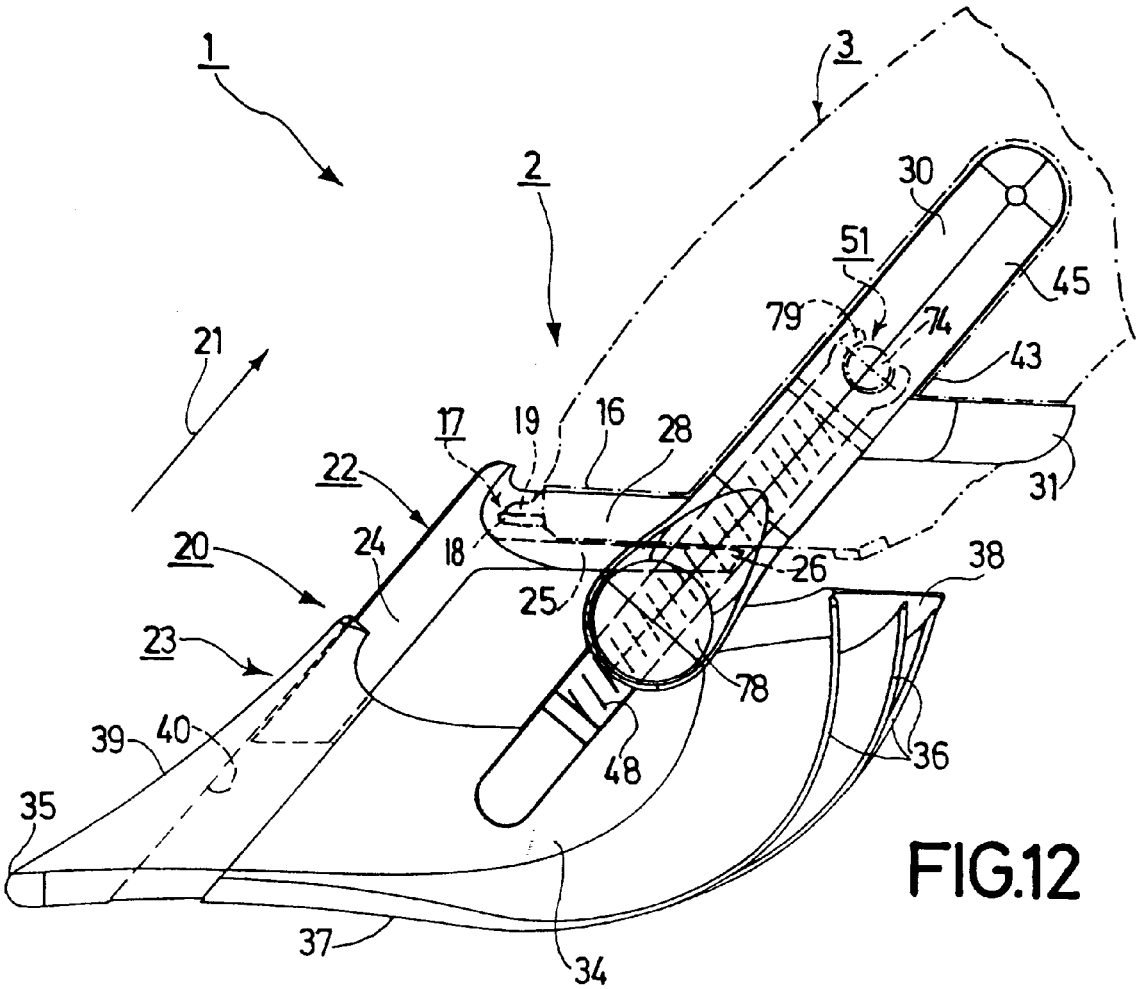
FIG. 12 shows, in the same way as FIG. 11, a part of a hair-cutting system in accordance with a second embodiment of the invention, in which a pressure spring is arranged between the stationarily mounted comb section of the comb device and the adjustable comb section of the comb device.

FIG. 12 shows a hair-cutting system 1 in accordance with a second embodiment of the invention. The hair-cutting system 1 as shown in FIG. 12 basically differs from the hair-cutting system 1 in accordance with the first embodiment as shown in FIGS. 1 to 11 in that the stationarily mounted comb section 22 and the adjustable comb section 23 are loaded relative to one another by means of spring 48 in the form of a pressure spring and in that the free ends of the further guide members 41 and 42 of the adjustable comb section 23 each comprise a latching clamp 79 which can be brought into latching engagement with a coupling pin 73 or 74. The two latching clamps 79 and the coupling pins 73 and 74 now form the coupling means 51 for automatically coupling the adjustment device, which is not shown in FIG.

12, and the adjustable comb section 23 when the comb device 20 is mounted onto the hair-cutting apparatus 2.

With the hair-cutting system 1 as shown in FIG. 12 it is also achieved in a simple manner that by means of the adjustment device, not shown, the adjustable comb section 23 is automatically movable into the operating position desired by a user, which position is determined by the selected setting of the adjustment device, when the comb device 20 is mounted onto the hair-cutting apparatus 2, as is apparent from FIG. 12. In the hair-cutting system 1 as shown in FIG. 12 the stationarily mounted comb section is held against the distal end 16 of the housing 3 of the hair-cutting apparatus 2 by means of the spring 48 formed by a pressure spring.

The invention is not limited to the two embodiments described by way example in the foregoing. Different constructions are possible both for the adjustment device, for the coupling means and for the comb device. For example, instead of only one spring two springs can be used for loading the stationarily mounted comb section and the adjustable comb section relative to one another. Moreover, instead of a helical tension spring or a helical pressure spring other spring constructions can be used; it is possible, for example, to use a rod spring which extends transversely to the comb teeth and which is fixedly connected to one of the two comb sections and acts resiliently upon the other one of the two comb sections. Such a rod spring can, for example, be made of a plastic just as the two comb sections and can be integral with one of the two comb sections.

We claim:

1. A hair-cutting system comprising a hair-cutting apparatus for cutting hairs, which apparatus is held in one hand during operation and comprises a toothed cutting device, and comprising a comb device which can be mounted onto the hair-cutting apparatus at the location of the toothed cutting device in a mounting direction and which can be removed from the hair-cutting apparatus in a direction opposite to the mounting direction, which comb device comprises a comb section which is stationarily mounted with respect to the hair-cutting apparatus when the comb device has been mounted on the hair-cutting apparatus, and a comb section which is adjustable with respect to the stationarily mounted comb section, and comprising positioning means by which the adjustable comb section can be positioned in at least two operating positions with respect to the stationarily mounted comb section, wherein the stationarily mounted comb section and the adjustable comb section are loaded relative to one another by means of at least one spring, and the positioning means comprise an adjustment device arranged on the hair-cutting apparatus, which adjustment device is adjustable to at least two selectable settings by the hand in which the hair-cutting apparatus is held during operation, and coupling means are arranged between the adjustment device and the adjustable comb section for automatically coupling the adjustment device and the adjustable comb section when the comb device is mounted onto the hair-cutting apparatus, and the adjustable comb section, when the comb device is mounted onto the hair-cutting apparatus, is automatically movable into a desired operating position with the aid of the adjustment device via the coupling means, which operating position is determined by the selected setting of the adjustment device.

2. A hair-cutting system as claimed in claim 1, wherein the adjustment device comprises a button, which can be set to at least two selectable settings by the hand in which the hair-cutting apparatus is held during operation, and a component part, which is movable by means of the button, and transmission means, which are connected to the component part and via which the component part is operatively connected to the coupling means.

3. A hair-cutting system as claimed in claim 2, wherein the component part, which is movable by means of the button, and the transmission means are connected to one another via a hinge connection.

4. A hair-cutting system as claimed in claim 2, further comprising means by which the button is latched in each of its at least two selectable settings.

5. A hair-cutting system as claimed in claim 1 wherein, when the comb device has been mounted on the hair-cutting apparatus, the adjustable comb section is adjustable with respect to the stationarily mounted comb section in a direction parallel to the mounting direction.

6. A hair-cutting system as claimed in claim 5, wherein the hair-cutting apparatus has a housing with a housing end, which housing has two diametrically opposed guide grooves, which extend parallel to the mounting direction and which are open at the housing end in the area of the toothed cutting device, and the stationarily mounted comb section comprises two guide members, which each engage stationarily in a respective one of said guide grooves when the comb device is mounted onto the hair-cutting apparatus, and the adjustable comb section comprises two further guide members, which each engage slidably in a respective one of said guide grooves when the comb device is mounted onto the hair-cutting apparatus, and the coupling means between the adjustment device and the adjustable comb section are accommodated in at least one of said two guide grooves.

7. A hair-cutting system as claimed in claim 6, wherein the two guide members of the stationarily mounted comb section are cross-sectionally U-shaped, their bottom walls being remote from one another, and the two further guide members are also cross-sectionally U-shaped, each of the U-shaped further guide members of the adjustable comb section engaging in a respective one of the U-shaped guide members of the stationarily mounted comb section.

8. A hair-cutting system as claimed in claim 7, wherein said at least one spring comprises a helical spring arranged at least between one of said U-shaped guide members of the stationarily mounted comb section and one of said U-shaped further guide members of the adjustable comb section, said one further guide member engages in said one guide member, said helical spring extends in the same direction as the said one further guide member and said one guide member and acts thereupon.

9. A hair-cutting system as claimed in claim 6 wherein the coupling means comprise coupling pins, which project from the interior of the housing of the hair-cutting apparatus into the guide grooves through passages in the housing, and coupling stops, which are arranged on the further guide members of the adjustable comb section.

10. A hair-cutting system as claimed in claim 9, wherein the coupling pins extend through slot-shaped passages formed in the bottom walls of the guide grooves.

11. A hair-cutting system as claimed in claim 1, wherein said at least one spring comprises at least one tension spring for loading the stationarily mounted comb section and the adjustable comb section relative to one another.

12. A hair-cutting system as claimed in claim 1, wherein the stationarily mounted comb section comprises a plurality of comb teeth, which extend down to the toothed cutting device and the adjustable comb section comprises an equal plurality of comb teeth, and when the adjustable comb section has been moved with respect to the stationarily mounted comb section opposed by the force of the spring the comb teeth of the stationarily mounted comb section forms extensions of the comb teeth of the adjustable comb section down to the toothed cutting device.

13. A hair-cutting system as claimed in claim 12, wherein the comb teeth of the stationarily mounted comb section are strip-shaped and extend parallel to the mounting direction with their longitudinal strip directions, and the comb teeth of the adjustable comb section are wedge-shaped and each have a channel which extends parallel to the mounting direction, one of the strip-shaped comb teeth of the stationarily mounted comb section extending in each channel.

* * * * *